US006234618B1

(12) United States Patent
Yamamoto et al.

(10) Patent No.: US 6,234,618 B1
(45) **Date of Patent: *May 22, 2001**

(54) INK ABSORBING BODY, INK TANK, INK-JET CARTRIDGE AND INK-JET PRINTING APPARATUS

(75) Inventors: Hajime Yamamoto, Yokohama; Eiichiro Shimizu, Urawa; Keisuke Matsuo, Yokohama; Teruo Arashima; Jun Hinami, both of Kawasaki; Wataru Takahashi, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/742,049

(22) Filed: Nov. 1, 1996

(30) Foreign Application Priority Data

Nov. 2, 1995 (JP) ..... 7-286231
Oct. 23, 1996 (JP) ..... 8-280879

(51) Int. Cl.[7] ..... B41J 2/175
(52) U.S. Cl. ..... 347/86
(58) Field of Search ..... 347/84, 85, 86, 347/87, 100, 108; 106/31.75

(56) References Cited

U.S. PATENT DOCUMENTS

| | | | | |
|---|---|---|---|---|
| 4,753,843 | | 6/1988 | Cook et al. | 428/286 |
| 5,489,932 | * | 2/1996 | Ceschin et al. | 347/87 |
| 5,624,484 | * | 4/1997 | Takahashi et al. | 106/31.75 |
| 5,654,086 | * | 8/1997 | Nishijima et al. | 442/199 |

FOREIGN PATENT DOCUMENTS

| | | |
|---|---|---|
| 488829 | 6/1992 | (EP) . |
| 619349 | 10/1994 | (EP) . |
| 640484 | 3/1995 | (EP) . |
| 704303 | 4/1996 | (EP) . |
| 2190111 | 11/1987 | (GB) . |
| 2268911 | 1/1994 | (GB) . |
| 6-15839 | 1/1994 | (JP) . |
| 6-255121 | 9/1994 | (JP) . |
| 8-20115 | 1/1996 | (JP) . |

* cited by examiner

*Primary Examiner*—N. Le
*Assistant Examiner*—Anh T. N. Vo
(74) *Attorney, Agent, or Firm*—Fitzparick, Cella, Harper & Scinto

(57) ABSTRACT

An ink absorbing body stores an ink injected into an ink tank for an ink-jet with capillary force between fiber. On a surface of said fiber before filling the ink, a surfactant is deposited within a range of 0.002 to 0.2 wt % relative to a weight of the ink or in a range of 0.01 to 0.5 wt % relative to a weight of the fiber.

22 Claims, 11 Drawing Sheets

INK ABSORBING BODY, INK TANK, INK-JET CARTRIDGE AND INK-JET PRINTING APPARATUS

BACKGROUND OF THE INVENTION

1. Field of the Invention

The present invention relates to an ink absorbing body to which ink is injected, an ink tank incorporating the ink absorbing body and being used for supplying a liquid through a supply opening as required, and a production method of the ink tank. The invention further relates to an ink-jet cartridge including an ink-jet printing head and an ink-jet printing apparatus.

2. Description of the Related Art

In an ink tank to be used in an ink-jet printing apparatus, the ink tank including an ink tank portion in a form of an ink-jet cartridge integrally incorporating a printing head, it is typical to provide means for adjusting a pressure of an ink stored in the ink tank to be negative pressure relative to the atmospheric pressure so as to obtain good ink supplying ability for an ink-jet printing head as printing means.

As generation means of such pressure, hereinafter referred to as "vacuum", an ink absorbing body formed of a polyurethane foam is frequently employed. It is the trend in the recent years to employ a method utilizing a fiber including a fiber bundle having directionality, felt or so forth.

For example, Japanese Patent Application Laid-open Nos. 15839/1994 and 255121/1994 disclose employment of an ink holding body formed of felt, respectively. Also, commonly owned Japanese Patent Application Laid-open No. 20115/1996 proposes an ink tank having a region of filling fibrous body at least at an ink supply side, wherein the fibrous body is deformed within a range of elastic bending, and wherein the fibrous body is filled within the region at the state of forming a plurality of intersections in various directions within the region.

On the other hand, considering the ink to be injected into the ink absorbing bodies above, there have been developed inks satisfying requirement for clearer color output on a plain paper, improvement of water resistance in a post card when ink is discharged on the surface of the post card, and so forth, in the recent years.

For example, in order to suppress bleeding at boundary region between the different color regions, which are adjacent to each other, upon color printing on the plain paper, it has been performed to discharge or eject a pre-treatment liquid at predetermined printing position on the printing paper in advance of ejection of the ink, and subsequently to eject a super-penetration type ink containing anionic dye to cause reaction with the pre-treatment liquid for making the dye insoluble. When measure for the foregoing requirement is taken by improving the ink, it has been required to define optimal physical property with respect to components contained in the ink.

The fiber to be used as the ink absorbing body has superior property in ink absorbing efficiency and chemical stability in contacting with the ink, in comparison with the method utilizing foamed body, such as polyurethane foam or so forth as the ink absorbing body, in the prior art. This is because the actual volume of the fibrous ink absorbing body in the internal volume of the ink tank is smaller than that of the conventional ink absorbing body of the foamed body, and because the fiber per se is not reactive to the ink.

Particularly, when polyolefin resin which is inexpensive and has superior acid resistance, alkalescence resistance and solvent resistance, is taken as material for the fiber, the fiber may have superior chemical stability relative to the ink. Therefore, the ink absorbing body has been designed under the premise of inert property relative to the ink.

However, the present inventors have found, as results of study, when the ink including an anionic dye is stored in the ink and stored for a long period at a temperature of 60° C., it has been found that significant variation of printing quality is possibly caused. Upon checking of physical property value of the ink, it has been found that the ink has higher viscosity and lower surface tension in comparison with initial physical property of the ink.

On the other hand, when the ink absorbing body is washed with pure water before injection of the ink, and the ink absorbing body absorbing the ink is stored for a long period under the same condition, difference of the printing quality can be seen in comparison with the case where washing of the absorbing body is not performed.

Through such experiments, the present inventors had obtained a conclusion that a substance which may cause physical property of the ink is deposited on the ink absorbing body, and, getting one step ahead, obtained a novel idea which could not be through of in the prior art. The idea is that, by positively utilizing the foregoing property of the substance, an optimal performance is provided for the ink absorbing body to be used with the ink tank for an ink-jet, which is optimal for ink injection before injecting of the ink and staple with respect to the ink after injection of the ink.

In viewpoint of such novel idea, production process of the ink absorbing body including the production process of the fiber as the elemental material, has been reviewed again. As a result, irrespective of the form of the fiber to be used, such as felt, fiber bundle or so forth, attention has been attracted to an oily material to be deposited on the fiber. As the oily material, a kind of oily material corresponding to application of the fiber is used. The depositing amount of the oily material on the fiber is in a ratio range of 0.5 wt % to 2 wt % with respect to the fiber weight, in the weight after drying. The oily material contains the surfactant in chemical composition.

SUMMARY OF THE INVENTION

The present inventors have paid attention to the oily material and the surfactant in the oily material and reached an invention of an innovative method to easily realize the idea as set forth above by utilizing the oily material and the surfactant contained therein as component.

The present invention has been worked out on the basis of such novel finding. Therefore, it is an object of the invention to provide an ink absorbing body to be injected an ink, which utilizes a fiber and can be used for inks of various physical property, an ink tank and an ink-jet cartridge using such ink absorbing body, and an ink-jet printing apparatus loading such ink tank or ink-jet cartridge.

In a first aspect of the present invention, there is provided an ink absorbing body storing an ink injected into an ink tank for an ink-jet with capillary force between fibers, wherein on a surface of the fiber before filling the ink, a surfactant is deposited within a range of 0.002 to 0.2 wt % relative to a weight of the ink.

Here, all of the surfactant deposited on the fiber may be removable from the surface of the fiber.

A part of the surfactant deposited on the fiber may be removable from the surface of the fiber.

In a second aspect of the present invention, there is provided an ink absorbing body storing an ink injected into an ink tank for an ink-jet with capillary force between fiber, wherein on a surface of the fiber before filling the ink, a surfactant is deposited within a range of 0.01 to 0.5 wt % relative to a weight of the fiber.

In a third aspect of the present invention, there is provided an ink absorbing body storing an ink injected into an ink tank for an ink-jet with capillary force between fiber, wherein a nonionic surfactant is deposited on the surface of the fiber.

Here, a cloud point of the surfactant in the ink may be higher than or equal to 65° C.

The ink absorbing body may be processed by heat forming at least the surface thereof.

The fiber may contain polyolefin type resin as primary component.

The polyolefin type resin may be polypropylene.

In a fourth aspect of the present invention, there is provided an ink tank, comprising:

an ink absorbing body storing an injected ink with capillary force between fiber; and a casing housing the ink absorbing body and having an atmosphere communicating portion, wherein on a surface of the fiber before filling the ink, a surfactant is deposited within a range of 0.002 to 0.2 wt % relative to a weight of the ink.

Here, the casing may have an ink supply opening, and the absorbing body may be housed within a region at the side of the ink supply opening among a region surrounded by the casing.

The casing may form an absorbing body receptacle chamber having inner periphery equivalent to the outer periphery of the absorbing body.

In a fifth aspect of the present invention, there is provided an ink tank comprising:

an ink absorbing body storing an injected ink with capillary force between fiber;

a casing housing the ink absorbing body and having an atmosphere communicating portion; and a nonionic surfactant being deposited on the surface of the fiber.

Here, the casing may be constructed by integrally forming at least one ink chamber storing an ejection liquid containing a cationic substance and at least one ink chamber storing an ejection liquid containing anionic substance, at least one of the ejection liquids may be a colored printing ink.

The casing may be constructed by arranging a plurality of ink containers including at least one ink container storing an ejection liquid containing cationic substance and at least one ink container storing an ejection liquid containing anionic substance, and a part of or all of the ejection liquids may be colored printing liquid.

In a sixth aspect of the present invention, there is provided an ink-jet cartridge comprising:

an ink tank, including:

an ink absorbing body storing an injected ink with capillary force between fiber; and a casing housing the ink absorbing body and having an atmosphere communicating portion, wherein on a surface of the fiber before filling the ink, a surfactant is deposited within a range of 0.002 to 0.2 wt % relative to a weight of the ink; and an ink-jet printing head for performing printing by ejecting an ejection ink stored in the tank on a printing medium.

In a seventh aspect of the present invention, there is provided an ink-jet cartridge comprising:

an ink tank, including an ink absorbing body storing an injected ink with capillary force between fiber;

a casing housing the ink absorbing body and having an atmosphere communicating portion; and a nonionic surfactant being deposited on the surface of the fiber; and an ink-jet printing head for performing printing by ejecting an ejection ink stored in the tank on a printing medium.

Here, the ink tank may be detachable relative to the ink-jet printing head.

In an eighth aspect of the present invention, there is provided an ink-jet printing apparatus, comprising:

an ink-jet cartridge, including:

an ink tank, having:

an ink absorbing body storing an injected ink with capillary force between fiber, and a casing housing the ink absorbing body and having an atmosphere communicating portion, wherein on a surface of the fiber before filling the ink, a surfactant is deposited within a range of 0.002 to 0.2 wt % relative to a weight of the ink, and an ink-jet printing head for performing printing by ejecting an ejection ink stored in the tank on a printing medium; and a carriage detachably mounting the ink-jet cartridge.

In a ninth aspect of the present invention, there is provided an ink-jet printing apparatus comprising:

an ink-jet cartridge, including:

an ink tank, having:

an ink absorbing body storing an injected ink with capillary force between fiber;

a casing housing the ink absorbing body and having an atmosphere communicating portion; and a nonionic surfactant being deposited on the surface of the fiber; and an ink-jet printing head for performing printing by ejecting an ejection ink stored in the tank on a printing medium.

Here, the ink tank may be detachable relative to the ink-jet printing head.

The production process of an ink tank including an ink absorbing body storing an injected ink with capillary force between fiber and a casing housing the ink absorbing body and having an atmosphere communicating portion, comprising the steps of:

preparing an ink absorbing body, in which, on a surface of the fiber before filling the ink, a surfactant is deposited within a range of 0.01 to 0.5 wt % relative to a weight of the fiber;

preparing the casing;

inserting the ink absorbing body into the casing; and injecting an ink into the ink absorbing body.

The step of depositing the surfactant may be performed in a step of preparing long fibers or short fibers.

In the step of depositing the surfactant, the surfactant to be deposited may be nonionic surfactant.

The ink tank production process may further comprise a step of performing compression heat forming of a fiber aggregate to have an external surface corresponding to an interior configuration of the casing.

The above and other objects, effects, features and advantages of the present invention will become more apparent from the following description of the embodiments thereof taken in conjunction with the accompanying drawings.

BRIEF DESCRIPTION OF THE DRAWINGS

FIGS. 10A, 10B and 10C show a yet further embodiment of the ink-jet cartridge of the present invention, in which FIG. 10A is an exploded perspective view of a color ink tank with three chambers;

FIG. 10B is an exploded perspective view of a black ink tank with one chamber;

FIG. 10C is an exploded perspective view of an ink-jet printing head, to which exchangeable ink tanks as shown in FIGS. 10A and 10B can be loaded.

DETAILED DESCRIPTION OF THE PREFERRED EMBODIMENTS

The preferred embodiments of the present invention will be discussed hereinafter in detail with reference to the accompanying drawings.

Figure 1:
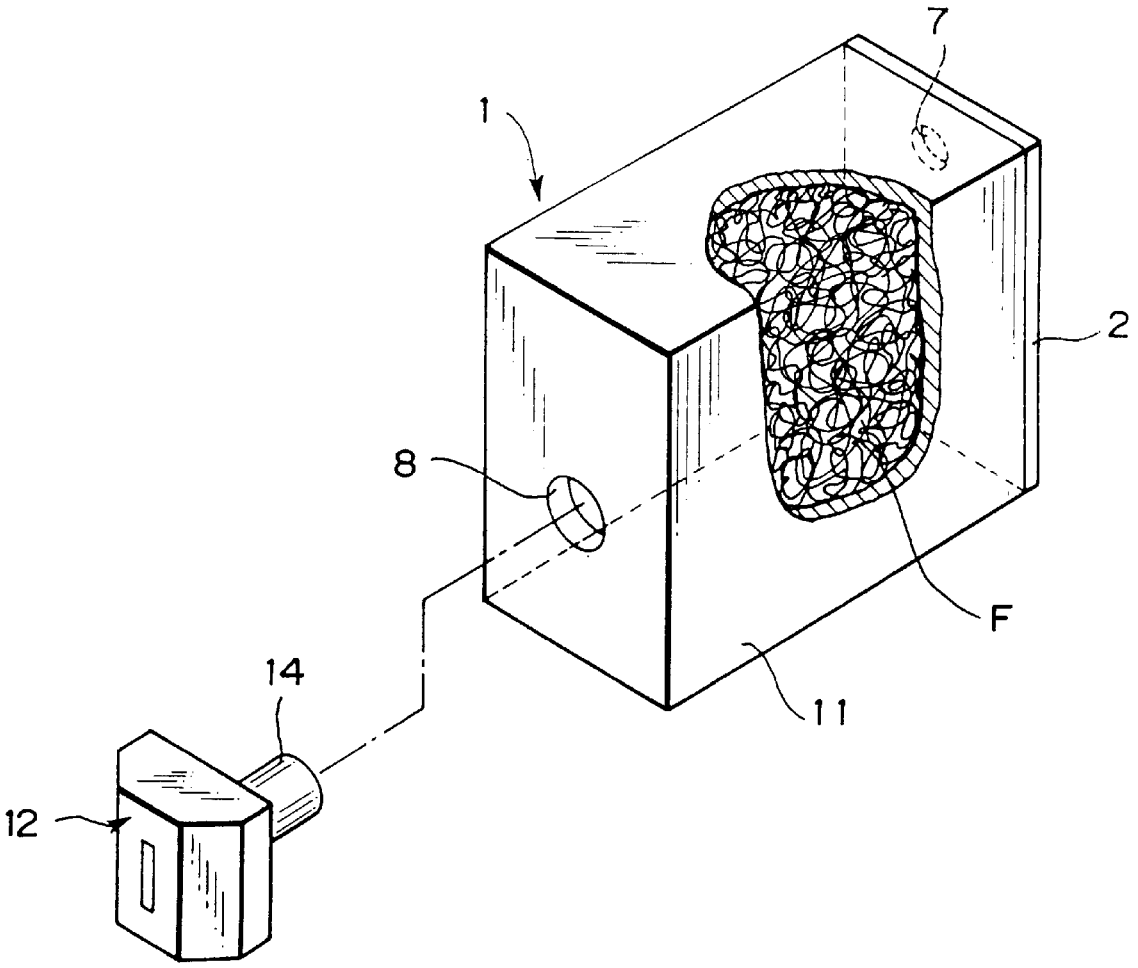
FIG. 1 is a perspective view for explaining a construction of an ink-jet cartridge, to which the present invention is applied.
Figure 3:
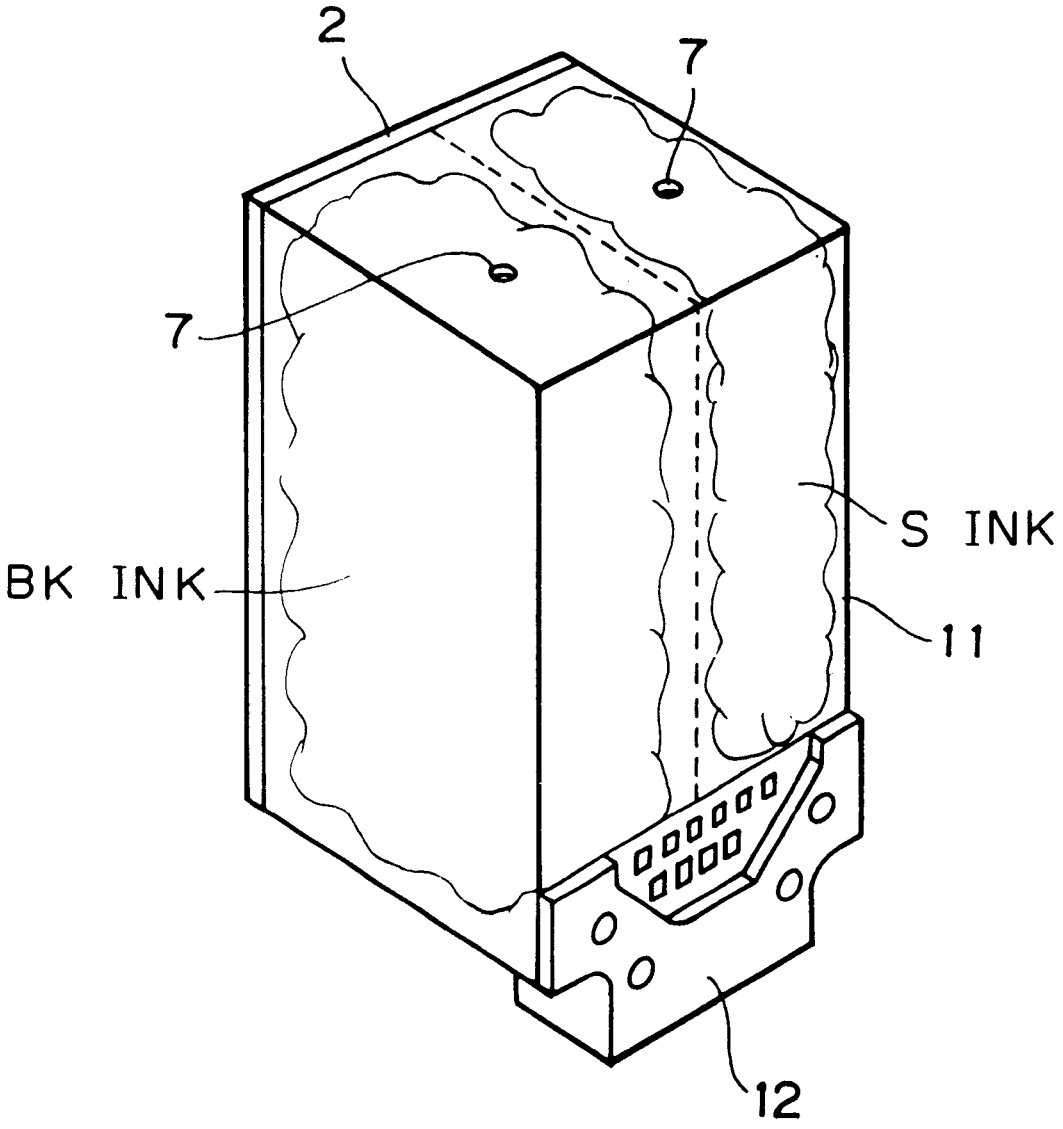
FIG. 3 is a perspective view showing another embodiment of the ink-jet cartridge, to which the present invention is applied.
Figure 9:
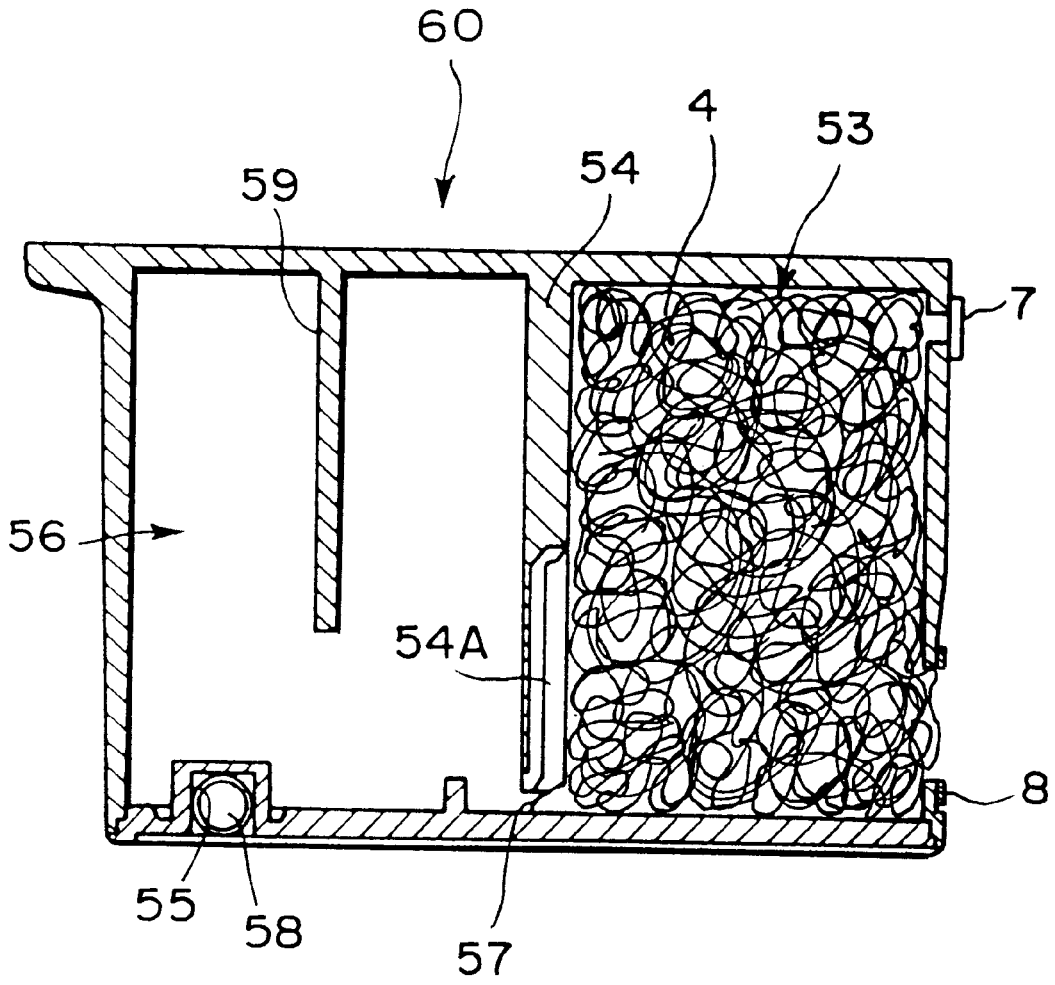
FIG. 9 is a section showing a still further embodiment of the ink-jet cartridge, to which the present invention is applied.
Figures 10A, 10B, 10C:
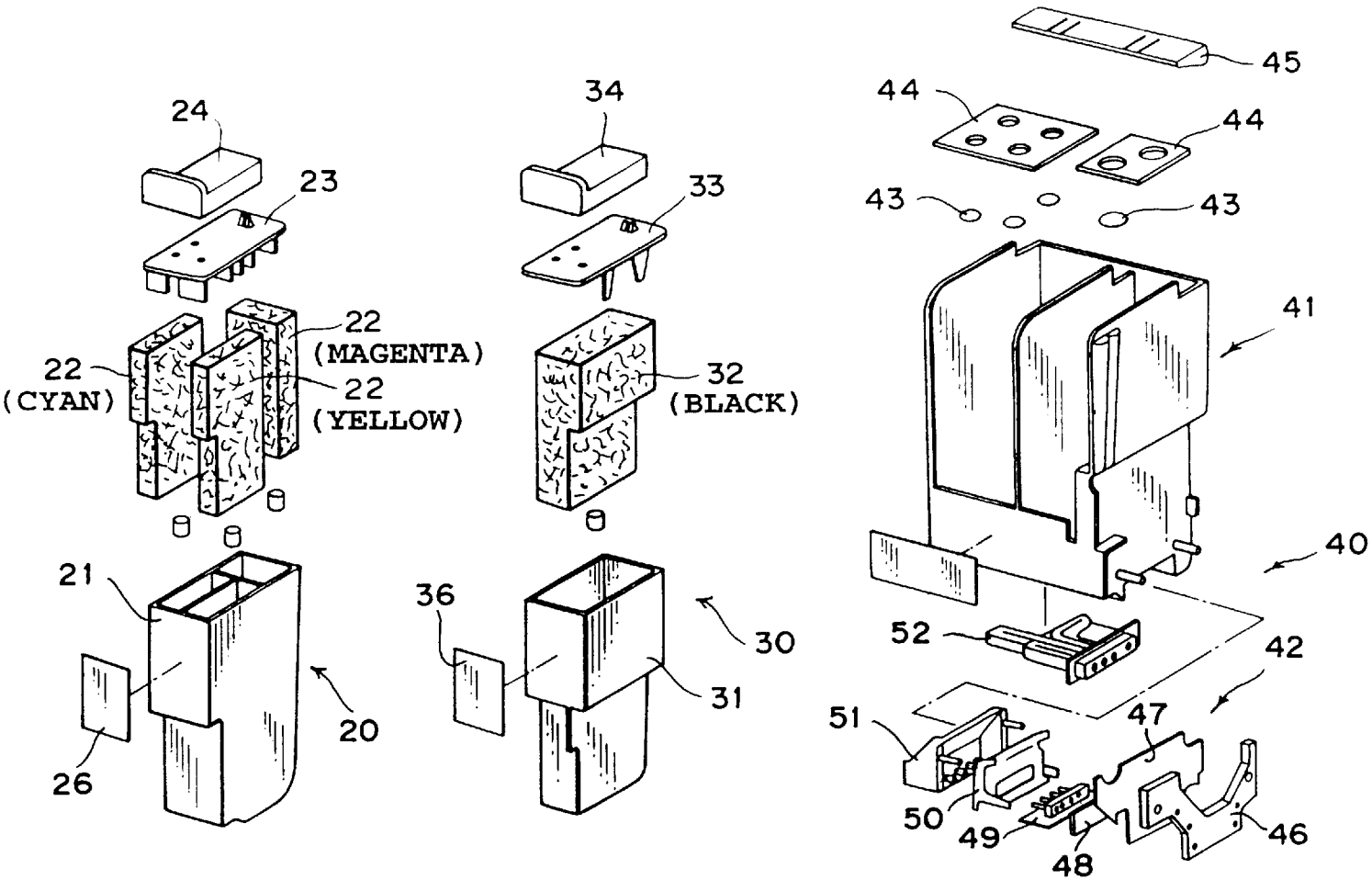

As form of implementation of an ink tank according to the present invention, it can be a construction with a single chamber is defined in an ink container as shown in FIGS. 1 and 10B, a construction of the ink container, interior space of which is divided into two chambers as shown in FIG. 3, a construction of the ink container, interior space of which is divided into a plurality of chambers for respective kinds of colors, and the divided chambers are integrated as shown in FIG. 10A, a construction of the ink container, interior space of which is divided into a plurality of chambers and a fibrous body as an ink absorbing body is housed within only one of the chambers, as shown in FIG. 9, or a construction to house the fibrous body within a chamber having an ink supply opening for supplying an ink to an ink-jet printing head and to communicate the chamber housing the fibrous body with one or more other chambers. It should be these forms of the ink tanks are merely examples and not exhaustive. Therefore, the present invention should not be taken to be limitative to the exemplified forms.

As form of implementation of an ink-jet cartridge according to the present invention, it can be a construction, in which the ink tank and the ink-jet printing head are mutually independent of each other and detachably coupled upon necessity, as shown in FIG. 10C, or a construction, in which the ink tank and the ink-jet printing head are integrated as shown in FIG. 3.

Figure 11:
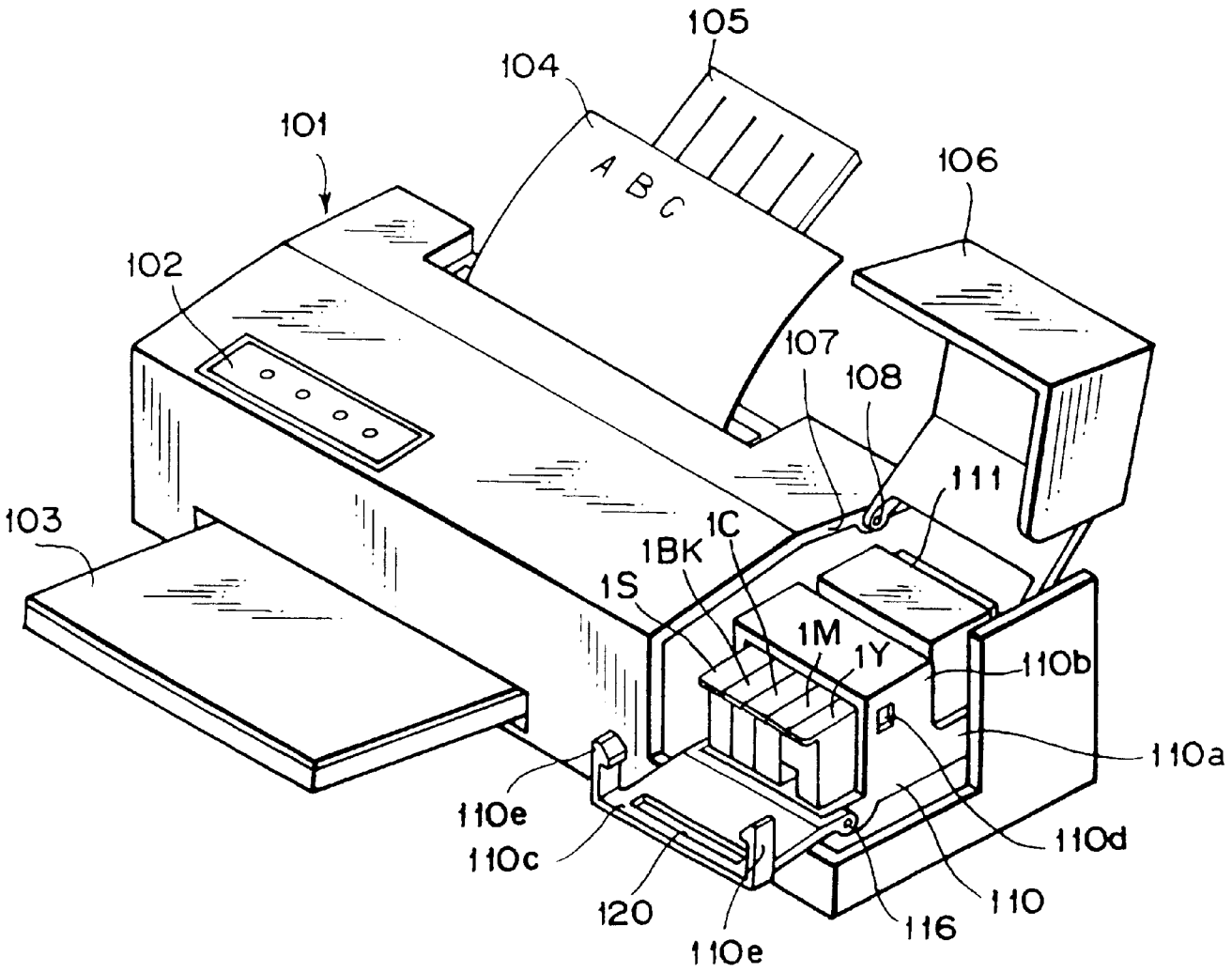
FIG. 11 is a perspective view showing a construction of an ink-jet printing apparatus, to which the ink tank as an ink-jet cartridge according to the present invention can be loaded.

As form of implementation of an ink-jet printing apparatus, it can be a construction with a carriage which can mount a plurality of ink tanks constructed as set forth above per kinds of colors, as shown in FIG. 11.

[First Embodiment]

FIG. 1 is a perspective view of an ink tank, to which the present invention is applied.

FIG. 1 is an ink tank which has been proposed in commonly owned Japanese Patent Application Laid-open No. 20115/1996. In an ink container 11 of an ink tank 1, an aperture 7 for communicating an interior space of the ink container 11 with the atmosphere. The ink container 11 is also formed with an ink supply opening 8 to be connected with an ink supply pipe 14 of and ink-jet printing head portion 12. Within a region defined by the ink container 11 and a lid 2, a fiber F as ink absorbing body capable of holding an ink by capillary effect is filled.

In the ink tank constructed as set forth above, in order to confirm an influence of a surfactant in an oily material, the inventors have performed experiments for amount of surfactant deposited on the fiber with respect to the ink with diethylene glycol (DEG) system ink type 1 containing following composition, in which surfactant is not prescribed.

Composition of Ink Type 1

| | |
|---|---|
| Dye (C.I.FB2) | 2 wt % |
| DEG(diethylene glycol) | 15 wt % |
| Ethanol | 5 wt % |
| Pure Water | 78 wt % |

After completely washing the fiber F, before making the ink type 1 of the foregoing composition absorbed in the fiber F, the diluted surfactant was deposited on the fiber F so that the weight of the deposited surfactant after drying is 0.05 to 1 wt % relative to the weight of the injected ink. After injecting the ink, printing quality of ejection from the printing head 12 is checked by checking fixing ability and bleeding. Thus, a result shown in the following table 1 was obtained. In the table 1, the fixing ability and bleeding are evaluated in five levels of 1 (NG or no good) to 5 (good), when evaluations of both are greater than or equal to four, the printing quality is excellent.

TABLE 1

| ADDITIVE AMOUNT OF SURFACE ACTIVE AGENT FOR INK (wt %) | EVALUATION OF FIXING ABILITY | EVALUATION OF BLEEDING |
|---|---|---|
| 1.0% | 5 | 3 |
| 0.5% | 5 | 3 |
| 0.25% | 4 | 3 |
| 0.2% | 4 | 4 |
| 0.1% | 4 | 5 |
| 0.05% | 4 | 5 |

On the basis of the foregoing experiments, a range of 0.2% to 0.25% of additive amount of the surfactant for the ink is further checked. As a result, it has been found that an upper limit of additive amount of the surfactant, at which no problem of printing characteristics is observed in fixing ability and bleeding, and no problem is arisen even in a high temperature storage test, such as at 60° C. or so forth, is 0.2%.

In consideration of ink characteristics, there is no lower limit. However, in view of preliminary treatment for the ink absorbing body, in comparison with the case where the surfactant is completely removed, in the production process of the ink tank and injection process of the ink, the following advantages can be found.

FIGS. 2A to 2E are explanatory views showing procedure for one example of production process of the ink tank.

Figures 2A, 2B, 2C, 2D, 2E:
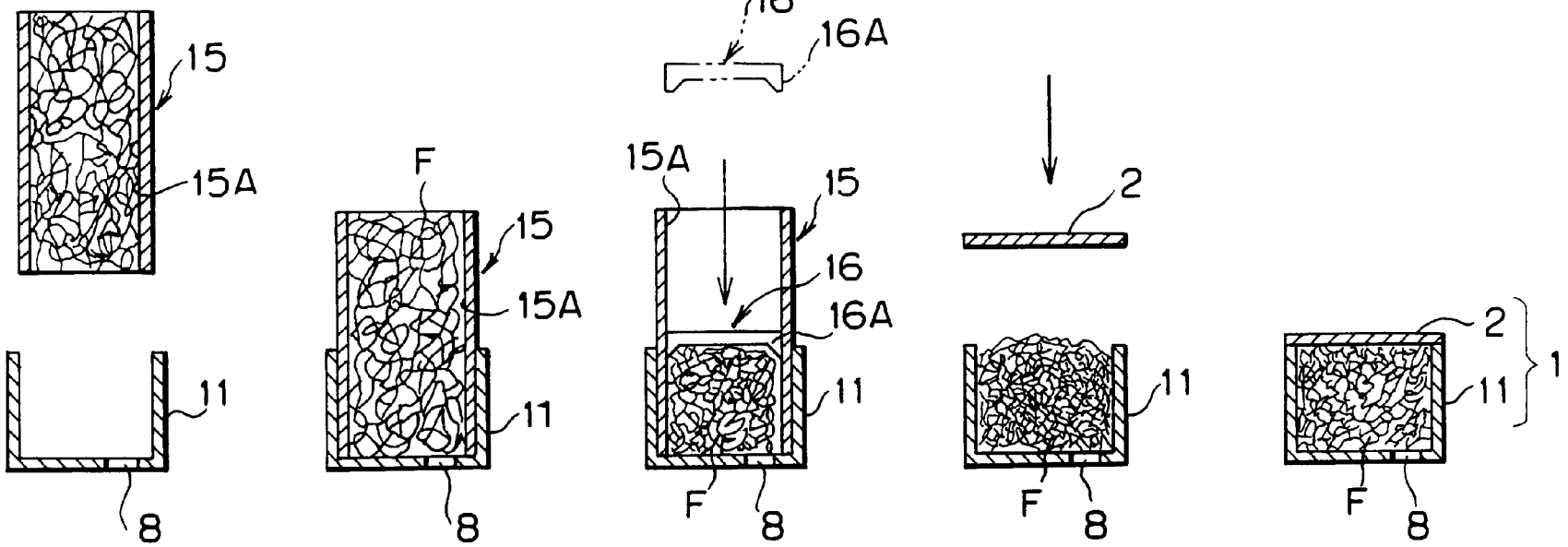
FIGS. 2A, 2B, 2C, 2D and 2E are explanatory views showing insertion method of an ink absorbing body into the ink-jet cartridge of FIG. 1.

Briefly explaining the production process with reference to FIGS. 2A to 2E, at first, as shown in FIG. 2A, a guide body 15 which can be inserted into the ink container 11 is prepared. The guide body 15 is a sleeve having opening at both ends. A distance between both ends is longer than a depth of the ink container 11. The fiber F is housed within the guide body 15 without fixing on the inner peripheral surface of the guide body 15. Next, as shown in FIG. 2B, the guide body 15 is inserted through an opening portion of the ink container 11 to arrange the lower portion of the guide body 15 within the container. Subsequently, as shown in FIG. 2C, by depressing the fiber F downwardly with a pushing member 16 inserted into the guide member 15 through an upper side opening to compress up to a size to be received within the container 11. At this time, in order to prevent the fiber from being pushed out through the ink supply opening 8, the ink supply opening 8 is sealed by a not shown sealing member as required. After completion of compression, the pushing member 16 and the guide body 15 are removed, as shown in FIG. 2D. Thereafter, by mounting the lid member 2, the ink tank is completed as shown in FIG. 2E.

In such production process of the ink tank, by depositing the surfactant on the surface of the fiber, lubrication is caused on the surface of the fiber, insertion of the fiber into the guide body 15 and the ink container 11 and removal of the guide body can be done quite smoothly. Also, in the process step to be compressed, the individual fibers may not be subject influence of static electricity to be compressed with sliding. Therefore, it becomes possible to provide the ink tank having ideal ink absorbing body for ink-jet without unexpected local fluctuation of compression density.

It should be noted that similar effect can be attained even when a fiber block is directly inserted into the container through an opening portion and closing the opening portion by the lid member, without employing the guide member as used in the foregoing production process.

On the other hand, FIGS. 6A to 6D and FIGS. 7A to 7D are explanatory views for ink injection process.

At first, ink injection process in the conventional polyurethane foam and manner of penetration of the ink into the ink absorbing body are briefly discussed with reference to FIGS. 6A to 6D.

Figure 6A:
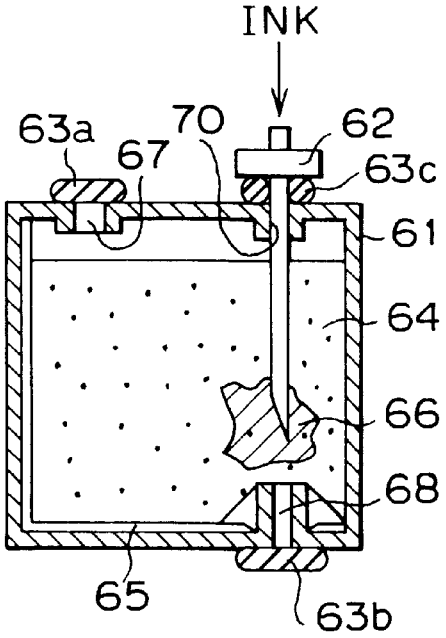
FIG.6A (PRIOR ART)
FIGS. 6A, 6B, 6C and 6D are explanatory views showing ink injecting process into an ink absorbing body of conventional polyurethane foam.
Figure 6B:
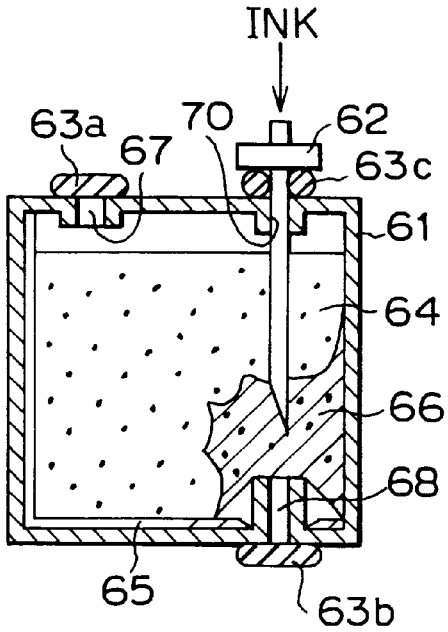
FIG.6B (PRIOR ART)
Figure 6C:
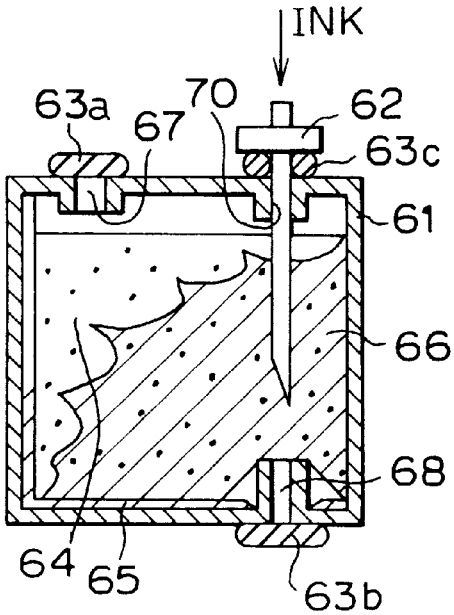
FIG.6C (PRIOR ART)
Figure 6D:
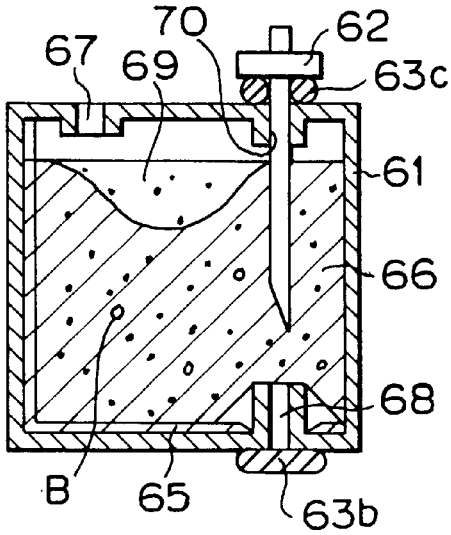
FIG.6D (PRIOR ART)

In FIG. 6A, through an ink injection hole 70 provided in an ink container 61, an ink injection needle 62 is inserted into the ink absorbing body 64 so that the tip end thereof is located in the vicinity of the ink supply opening 68. The ink supply opening 68, the atmosphere communication opening 67 and the ink injection hole 70 are sealed with sealing members 63*a*, 63*b* and 63*c*. After reducing pressure within the ink container 61, the ink is gradually absorbed into the ink absorbing body 64. However, due to low wettability of the ink absorbing body 64 per se, the ink may flow through a space 65 defined by a not shown aeration rib provided within the ink container 61. Once ink flows through the space 65, the ink flows through the space 65 rather than the ink absorbing body 64, as shown in FIG. 6C. In the worst case, when ink injection is terminated as shown in FIG. 6D, a region 69 where the ink is not penetrated even once is formed in the ink absorbing body 64, or fine bubble B is remained even in the region where the ink is penetrated.

Even when the ink absorbing body formed of a hydrophobic fiber is washed completely, various measure has been taken to avoid the foregoing problems are taken to make the production process complicate.

On the other hand, penetration of the ink into the ink absorbing body in the ink injection process in the case where the surfactant is deposited, as shown in FIGS. 7A to 7D.

Figure 7A:
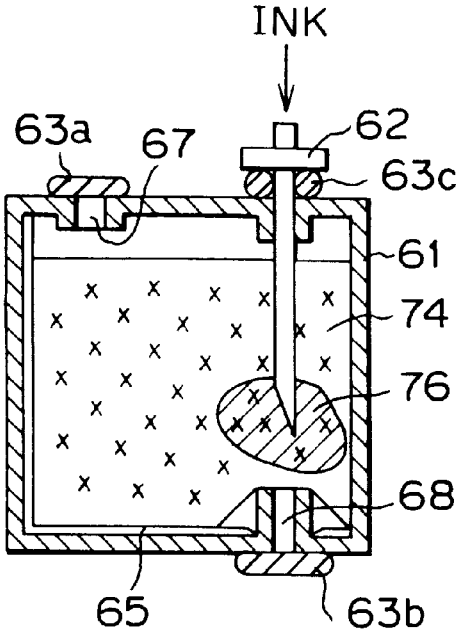
FIGS. 7A, 7B, 7C and 7D are explanatory views showing an ink injecting process into an ink absorbing body employing the ink absorbing body of the present invention.
Figure 7B:
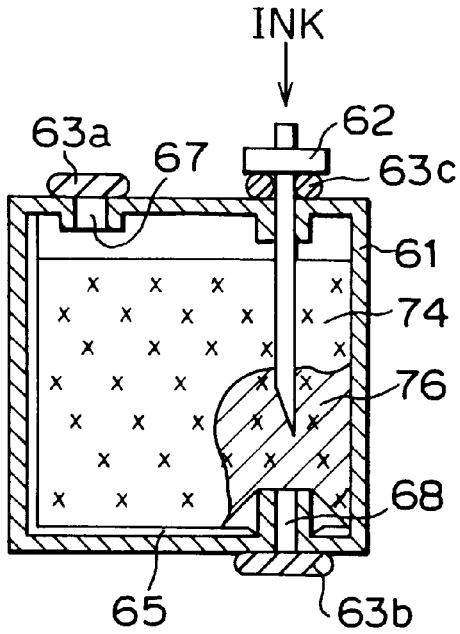
Figure 7C:
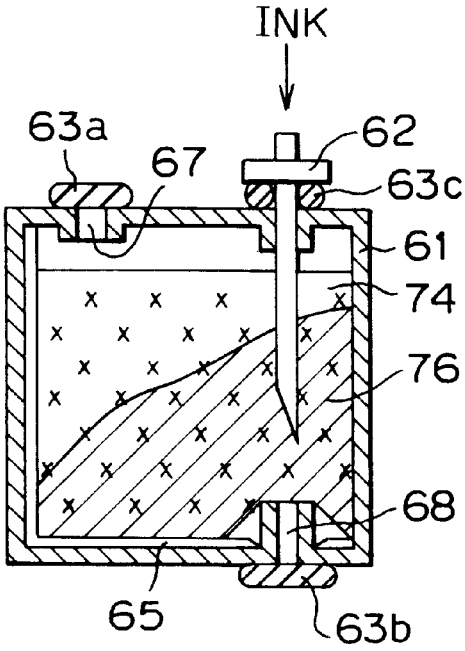
Figure 7D:
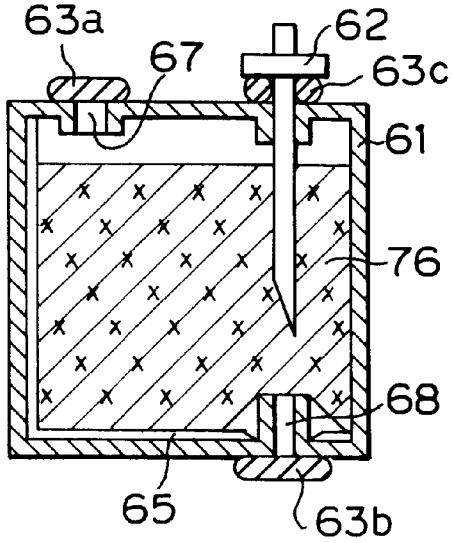

As shown in FIG. 7A, the ink is injected through the ink injection needle 62 and penetrates into the ink absorbing body 74. Here, even when the fiber employed in the ink absorbing body 74 is hydrophobic material, it has hydrophilic property by depositing the surfactant on the surface. Therefore, as shown in FIGS. 7B and 7C, since a power generated by capillary action between fibers on the surface of the fiber F is stronger than a power which destroys meniscus between the fibers on the surface of the fiber F, the ink can certainly penetrate into the ink absorbing body without flowing into the space 65. As a result, as shown in FIG. 7D, at the process step where the ink injection is completed, holding of the ink within the entire of the regions of the ink absorbing body 74 becomes possible. On the other hand, in the region 76 penetrated by the ink, there is no possibility to maintain fine bubble.

While the above-mentioned ink injection process is performed by injection under vacuum condition, the ink can be injected into the ink absorbing body even by pressure injection under atmospheric pressure when the ink absorbing body according to the present invention is employed to permit further simplification of the production process. In order to attain the effect of the present invention as set forth above, it is required that the surfactant is deposited on the fiber to be used as the ink absorbing body. As a result of experiments performed by the inventors, it has been confirmed that the foregoing effect can be expected when the deposition amount of the surfactant for the ink absorbing body is at least greater than or equal to 0.02 wt % in relation to the weight of the ink absorbing body.

Corresponding to radius, form and sizing of fibers of the ink absorbing body utilizing fibers, since property of the ink absorbing body can be maintained when the fiber weight of the ink absorbing body is about 3 to 10 times of the amount of ink to be absorbed in the ink absorbing body, the foregoing effect can be expected by depositing the surfactant on the surface of the ink absorbing body so as to increase the concentration of the surfactant by 0.002 wt % to the amount of the ink to be injected into the ink absorbing body.

From the result of experiments, it has been found that as amount of the surfactant to be preliminarily deposited on the ink absorbing body is preferred to be in a range of 0.002 to 0.2 wt % in relation to the ink, or 0.01 to 0.5 wt % in relation to the weight of the fiber in the ink absorbing body.

Figure 4B:
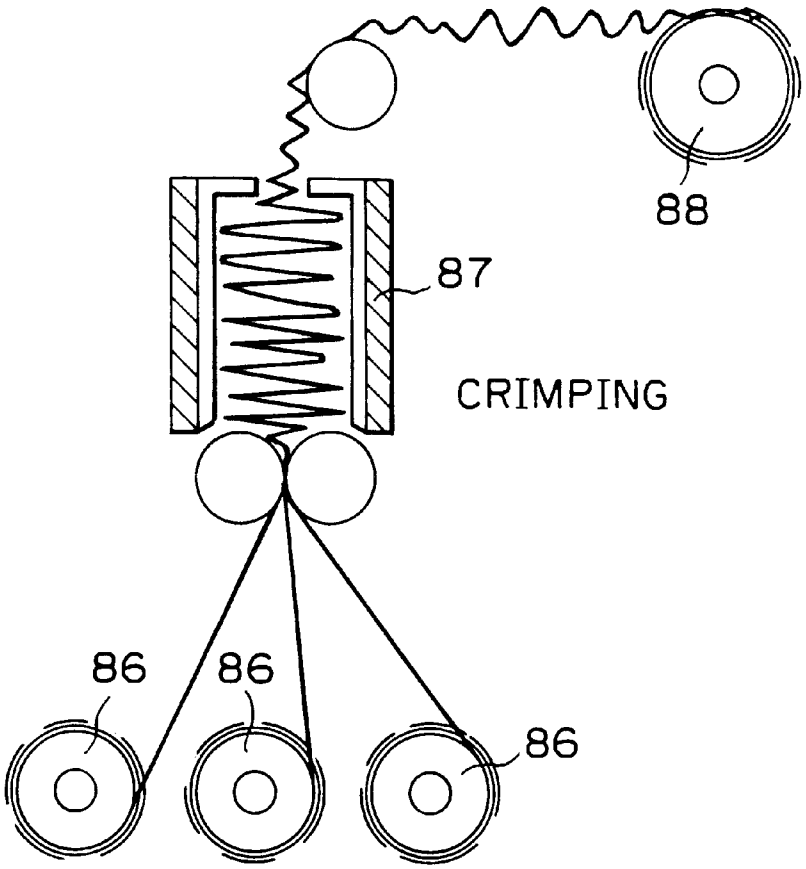
FIGS. 4A and 4B are diagrammatic views showing manufacturing process of filament or long fiber.
Figure 4A:
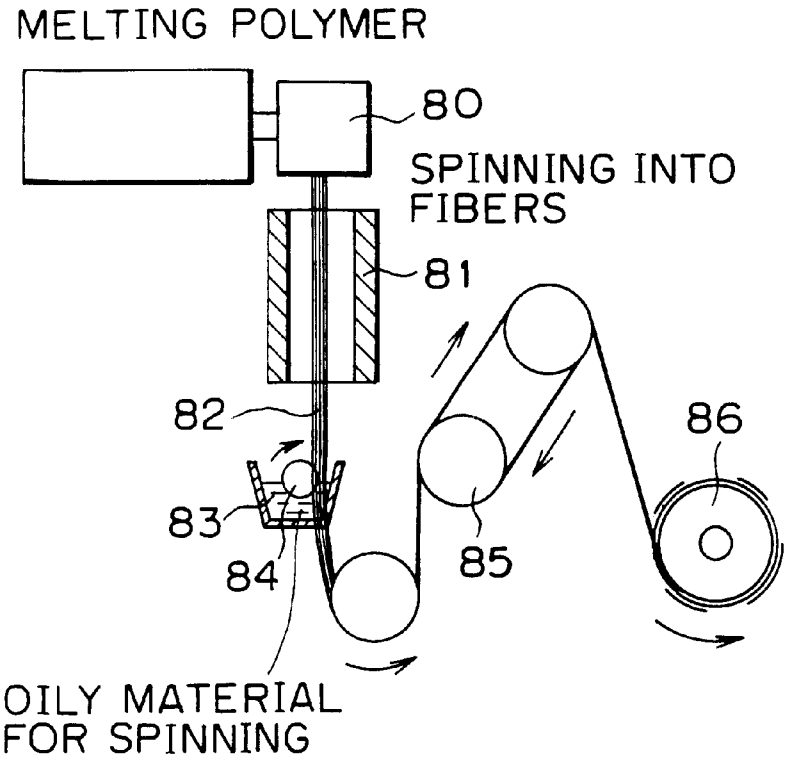

For depositing the above-mentioned amount of the surfactant on the ink absorbing body before insertion into the ink tank and injection of the ink into the ink tank, it is possible to deposit the necessary amount of the surfactant after completely washing the fiber. It is also possible to realize deposition of the surfactant utilizing the production process of the fiber. Therefore, discussion will be given with respect to a method utilizing the production process of the fiber with reference to FIGS. 4A and 4B and FIGS. 5A and 5B. As the fiber to be used in the ink absorbing body, synthetic fiber is frequently used. The synthetic fiber is generally classified into a filament (long fiber) and a staple (short fiber). FIGS. 4A and 4B show production process of the filament, and FIGS. 5A and 5B show production process of the staple.

When the ink absorbing body contains long fiber, a material resin is molten and extruded by an extruder, and subsequently cooled by an air cooling tube 81 for fiber spinning, as shown in FIG. 4A. On the surface of the fiber after cooling, diluted fiber spinning oily material 83 is applied by a roller 84. Then, the fiber is taken up on a bobbin via stretching by means of a roller 85. Thereafter, as shown in FIG. 4B, a plurality of bobbins 86 are set in a crimper 87 for taking up a take-up coil 88.

Figure 5A:
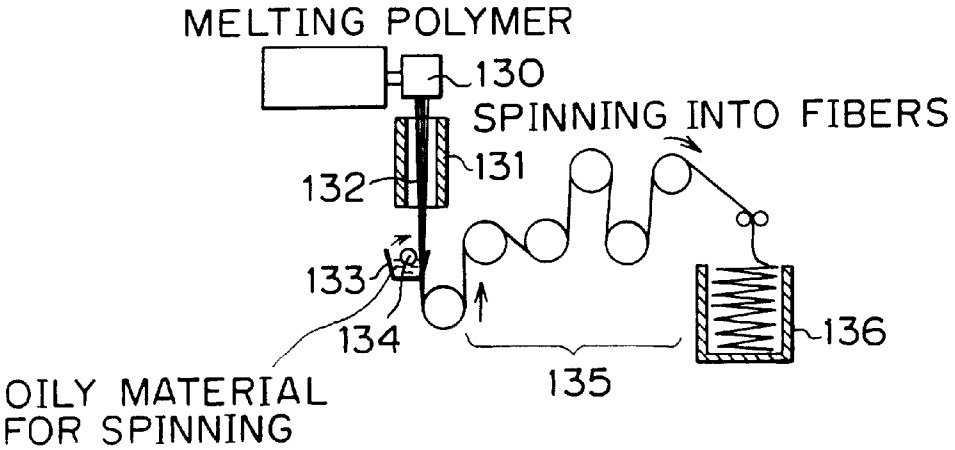
FIG. 5A and 5B are diagrammatic views showing manufacturing process of staple or short fiber.
Figure 5B:
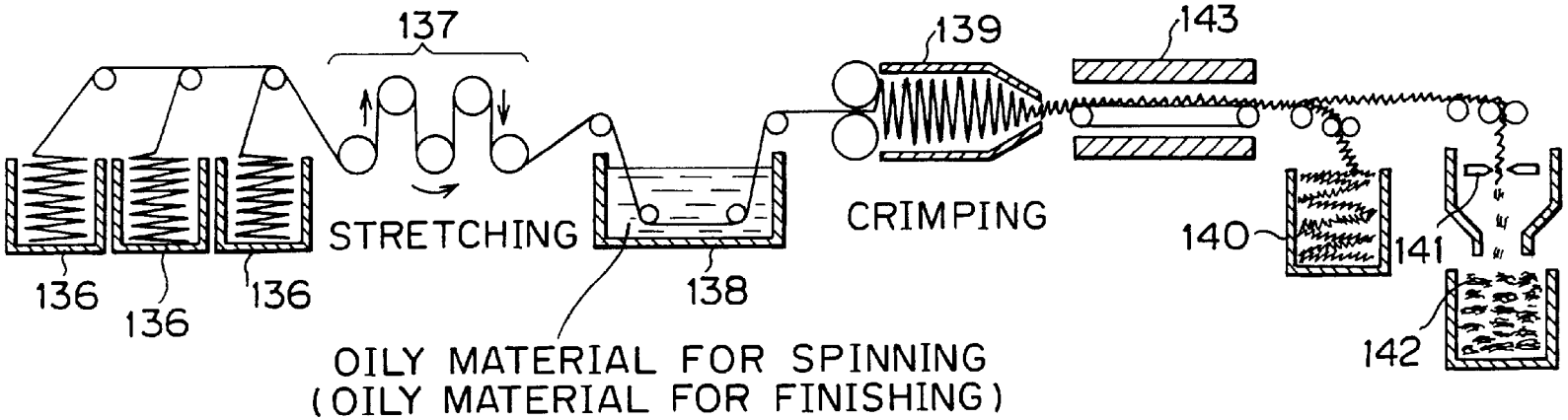

On the other hand, as shown in FIG. 5A, when the ink absorbing body contains short fiber, the material resin is molten and extruded by a extruder 130, and subsequently cooled by an air cooling tube 131 for fiber spinning. After the cooling, the fiber spinning oily material 133 is applied to the cooled fiber 132 by a roller 134. Then, the fiber is stretched by a roller 135 and subsequently received within a coiler can 136. Subsequently, as shown in FIG. 5B, the bundle of the fibers derived from a plurality of coiler cans 136 are aggregated to perform stretching by a roller 137, again to deposit the diluted fiber spinning oily material as a finishing oily material 138. After depositing, the fibers are crimped by a crimper 139. Depending on the application of the fiber, tow 140 or one formed by cutting the tow 140 by a cutting machine 141 to use it as a staple fiber.

In the foregoing process, the fiber spinning oily material 83 is deposited in case of the long fiber, the fiber spinning oily material 138 is deposited in case of the short fiber. The composition of the surfactant contained in the oily material can be limited within a range of 0.002 to 0.2 wt % with respect to the ink filled in the ink absorbing body so that the foregoing effect can be attained without newly providing the deposition step.

In this case, the deposition amount of the oily material is different from the amount of the oily material to be normally used in production process. After production of the fiber, before inserting into the ink container as the ink absorbing body, the amount of the surfactant deposited on the ink absorbing body may be controlled by for maintaining within the foregoing range. On the other hand, no problem will be arisen even when a part of the surfactant is remained.

As the oily material to be used, mainly the surfactant is used. Also, it is preferred that the oily material is an anionic surfactant with static electricity suppressing function and lubricating function. In concrete, anionic surfactant is selected among polyoxyethylene sorbitan fatty acid ester, polyethylene glycol aliphatic carboxylic acid ester and so forth.

It should be noted that the ratio of the surfactant occupying in the oily material is preferred to be 60 to 100%. In order to adapt to variation of the temperature of the use environment, it desirable that a temperature of the cloud point is higher than or equal to 65° C. However, the cloud point is a physical property value unique to the nonionic surfactant. The nonionic surfactant shows a property to be solved in the water at a temperature lower or equal to a cloud point, and greater than or equal to the flame of day light saving.

[Second Embodiment]

FIGS. 10A to 10C show the second embodiment of an ink-jet cartridge according to the present invention, wherein FIG. 10A is an exploded perspective view of a color ink tank 20 with three chambers, FIG. 10B is an exploded perspective view of a black ink tank 30 having a single chamber, and FIG. 10C is an exploded perspective view of an ink-jet printing head 40 which can be loaded exchangeable ink tank shown in FIGS. 10A and 10B.

The color ink tank 20 is generally constructed with a tank main body 21, an ink absorbing body 22 contained needle-punch felt and fibrous body, and housed within each of the three chambers, respectively, a lid body 23 for closing the opening portion of the tank main body 21, and a grip plate 24 fixed to one surface of the lid body 23 and for gripping the tank main body 21. The ink absorbing bodies 22 have shapes respectively formed adapting to the configurations of respectively corresponding chambers and are divided into those for yellow, cyan and magenta. The reference numeral 26 denotes a label for indicating information content of the ink tank.

On the other hand, the black ink tank 30 is generally constructed with a tank main body 31, an ink absorbing body 32 containing fibrous body and housed within the chamber of the tank main body 31, a lid body for closing the opening body of the tank main body 31, and a grip blade 34 for gripping the tank main body 31. The reference numeral 36 is a label for indicating information content of the ink tank.

The ink-jet printing head 40 is generally constructed with a tank holder 41 for loading respective of the ink tanks set forth above, and a printing head portion 42 mounted on the holder 41. The tank holder 41 includes a filter mounted at a tip end portion of an ink supply pipe (not shown) to be inserted into an ink supply opening (not shown) of respective ink tank for removing impurity in the ink, an elastic member 44 as a sealing member primarily for preventing evaporation of the ink after loading of the tank, and a locking member 45 for fixing the tank to the holder 41. The printing head portion 42 includes a base plate 46, a printing wiring board (PWB) 47, a heater board (HB) 48, a grooved ceiling plate 49, a retainer spring 50, a tip tank 51, and a fluid passage member 52.

In the shown embodiment, a black ink is a high surface tension ink and three color inks of yellow, magenta and cyan are low surface tension ink. Physical property of ink, such as stability and so forth is evaluated by varying nonionic surfactant containing polyoxyethylene alkyl ether as primary component (60 to 80%) within a range of 0 to 2% in fiber weight ratio. Within a range of 0 to 0.01%, it was difficult to stably maintain binding ability in fiber spinning process. On the other hand, within a range of 0.5 to 2%, even in consideration of maintenance of ink at least 3 to 5 times of amount of the absorbing body, substantial change of physical property of the ink is inherent.

On the other hand, within a range of 0.01 to 0.5%, particularly within a range of 0.1 to 0.2%, binding ability in fiber spinning process is good, and insertion of the ink absorbing body into the ink tank can be done smoothly. Also, even after housing the fibrous body as the ink absorbing body within the ink tank container, remaining surfactant shows hydrophilic property to maintain the ink by pressure injection under atmospheric pressure. The ink thus held had not cause variation of physical property even in high temperature storage test at 60° C. On the other hand, with respect to ink injection amount, sufficient use efficiency higher than or equal to 80 to 90% with respect to ink injection amount can be obtained. This demonstrates efficiency which can be higher and never be lower in comparison with the ink tank employing the absorbing body of polyurethane foam.

As such nonionic surfactant, polyalcohol ester type surfactant, polyether type surfactant, namely polyoxyethylene sorbitan fatty acid ester, polyethylene fatty acid ether or so forth, good selection becomes possible. In concrete, New Pole or Noni Pole of Sanyo Kasei Kogyo Kabushiki Kaisha, or Delion from Takemoto Yushi Kabushiki Kaisha may be selected.

[Third Embodiment]

FIG. 3 is a perspective view showing the third embodiment of an ink tank according to the present invention with an internal structure. The ink tank is constructed by integrally forming the ink container 11 and an ink jet printing head 12. The interior space of the ink container 11 is divided into two chambers. The fibrous bodies as the ink absorbing bodies are housed within both chambers. In one chamber, block ink (also referred to as Bk ink) is filled, and in the other chamber, a special ink (also referred to as S ink) is filled. This S ink is ejected to the predetermined printing position on the printing paper in advance of Bk ink and is a substantially achromatic and substantial transparent liquid having a property to make the ejected Bk ink insoluble. The reference numeral 2 denotes the lid body of the ink container 11.

In the shown embodiment, polyester fiber is used as the ink absorbing body. In general, as binding agent and antistat agent to be used in the process from fiber spinning to fabrication of felt, anionic surfactant, such as alkyl sulfoacetate, is used. Such anionic surfactant, in a range of 0.02 to 0.2%, will not cause problem in the black ink. However, in case of cation type special ink, significant variation of the physical property was caused. Therefore, only felt absorbing body for the special ink was washed completely. This inherently require extra process. Furthermore, the felt after washing has hydrophobic property, ink injection process becomes complicate.

In the shown embodiment, similarly to the foregoing second embodiment, as the nonionic surfactant, Delion PP-645 is selected and fabricated into felt. The felt is used as common ink absorbing body for anionic and cationic ink. Then, it has been confirmed stability of physical property in high temperature storage and long period storage tests.

As set forth, in printing method to particularly superior water resistance by reacting cationic substance and anionic substance on the printing paper as a printing medium, by employing the ink absorbing body containing normal fibrous body deposited the nonionic surfactant instead of preparing dedicated the ink absorbing body containing cationic substance and the ink absorbing body containing anionic substance, it becomes possible to provide superior ink storage stability both for the ink containing anionic substance and the ink for containing cationic substance. Thus, the same fibrous body may be used.

[Fourth Embodiment]

Figure 8A:
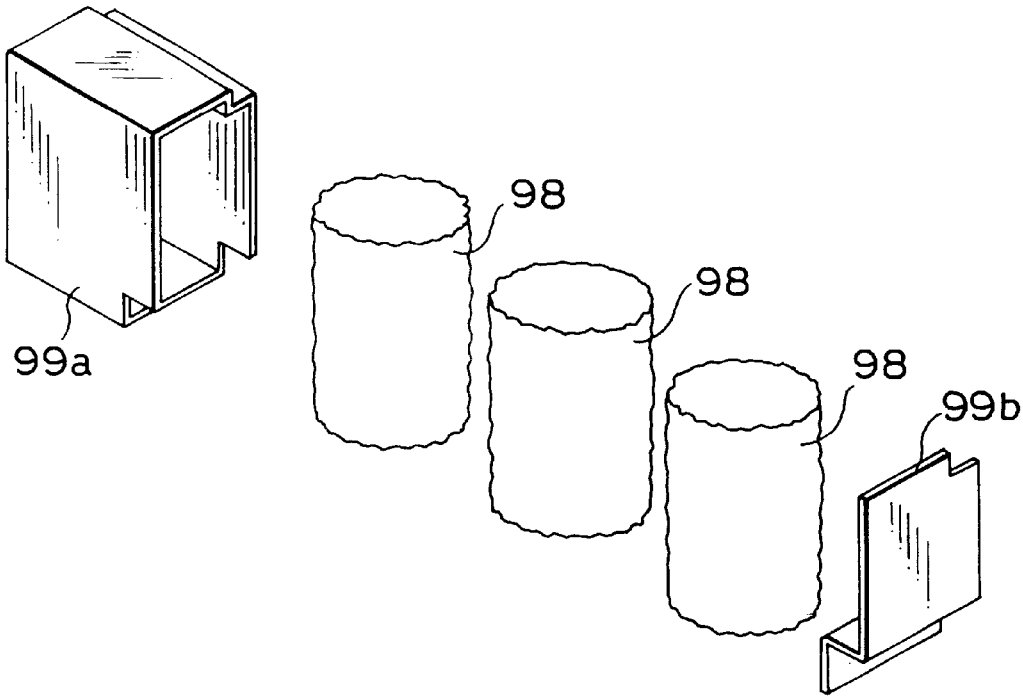
FIG. 8A is an explanatory view showing explaining a production process of a further embodiment of the ink-jet cartridge, to which the present invention is applied.
Figure 8B:
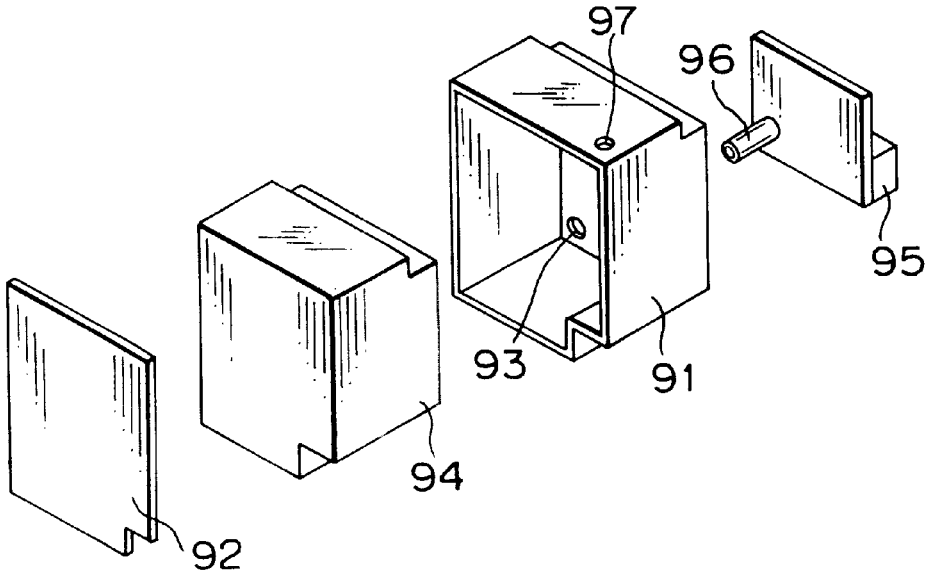
FIG. 8B is an exploded perspective view of an ink tank to be produced through the production process of FIG. 8A.

FIGS. 8A and 8B show the fourth embodiment of an ink tank (ink-jet cartridge) according to the present invention.

FIG. 8A is an explanatory illustration for explaining the fourth embodiment of a production method of the ink-jet cartridge, to which the present invention is applied, and FIG. 8B is an exploded perspective view of the ink tank to be produced through the production process of FIG. 8A.

As shown in FIG. 8B, similarly to other embodiment, the ink-jet cartridge according to the present invention includes an ink container 91, a lid member 92, an ink supply opening 93, an ink absorbing body 94, a printing head portion 95, an ink supply pipe 96, an atmosphere communication opening 97. The shown embodiment is differentiated from the foregoing other embodiments in that the ink absorbing body 94 containing the fiber is compress-heat formed at least on the surface to have external surface equivalent to or corresponding to the internal surface of the portion to house the ink absorbing body of the ink container.

Such ink absorbing body 94 can be formed by inserting a fiber bulk 98 into a mold 99*a* under pressure, subsequently closing a lid 99*b* and heating the mold, as shown in FIG. 8A. Similarly to the other embodiments, even in the shown embodiment, since the surfactant is deposited on the surface of the fiber bulk 98, the ink absorbing body ideal for ink-jet, which can be inserted into the mold smoothly, and, similarly to the first embodiment, has no unexpected local fluctuation of density, can be produced. On the other hand, by setting the temperature in the extent higher than or equal to enable heat formation and not to cause alternation of component of the surfactant, the effect upon insertion of the ink absorbing body 94 into the ink container 91 and injection of ink into the ink tank equivalent to other embodiment can be obtained.

In the shown embodiment, in concrete, the fiber block utilizes fiber of mixture of polypropylene fiber and polyethylene fiber in the weight ratio of 7:3. The heating temperature can be determined in a range higher than melting point of polyethylene fiber and lower than melting point of polypropylene fiber, 135 to 155° C. in the shown embodiment. Similarly to other embodiment, effect in insertion of the ink absorbing body into the ink tank and ink injection into the ink tank can be obtained.

[Fifth Embodiment]

FIG. 9 is a perspective view showing the fifth embodiment of the ink tank (ink cartridge) according to the present invention.

In the shown embodiment, the ink tank is an independent separation type tank of one ink in one tank with respect to the printing head (not shown in FIG. 9).

As shown in FIG. 9, the ink cartridge 60 has an internal structure constituted of two ink chambers communicated via a communicating portion 57 of a rib 54. Within a vacuum generating member receptacle portion 53 as a first ink chamber, a fibrous absorbing body 4 as vacuum generating member is received. On wall portion of the vacuum generating member receptacle portion 53, the atmosphere communication opening 7 for communicating the ink supply opening 8 connected to the ink supply pipe of the ink-jet printing head (not shown) and the vacuum generating member receptacle portion 53 to the atmosphere, is provided.

On the other hand, on the bottom portion of the ink receptacle portion 56, the opening portion 55 for filling the ink into the ink cartridge 60. Within the opening portion 55, a sealing member 58 is provided.

In the rib 54 within the ink cartridge 60 in such construction, the foregoing communicating portion 57 is formed in the vicinity of the bottom portion of the ink cartridge 60. On the other hand, a groove 54A for performing air/liquid exchange with atmosphere introduced into the vacuum generation member receptacle portion 53 via the atmosphere communicating portion 7, is extended from the position in the vicinity of the communicating portion 57 to the wall portion of the rib 54 at the side of the vacuum generation member receptacle portion 53. By this, at first the ink of the vacuum generating member receptacle portion 53 is consumed. When the liquid level of the ink within the vacuum generation member receptacle portion 53 substantially reaches the groove a, the ink of the ink receptacle portion 56 is supplied to the vacuum generation member receptacle portion 53 via the communicating portion 57 by air/liquid conversion to be consumed.

Even in the shown embodiment, the effect of the present invention is confirmed. It should be noted that, as resin material of the fiber, material having no problem in ink contacting ability, such as polyester, polysulfone, polypropylene and so forth can be selected. However, as a material which is inexpensive, light weight and easily obtained, polypropylene is most preferred. To form the ink tank by housing the fibrous absorbing body of the present invention within a transparent tank container of polypropylene material can provide not only capability of visually confirming of ink remaining amount but also the enhancement of resin recycling ability to reuse the material for producing the ink tank with taking high efficiency of ink usage as one of the advantages of the fiber absorbing body, namely with taking small amount of remaining ink.

The ink tank of such construction can be loaded as exchangeable tank in the ink-jet printing apparatus as shown in FIG. 11, for example.

FIG. 11 is a perspective view showing a construction of an ink-jet printing apparatus, to which the ink tank (ink cartridge) according to the present invention, is applicable.

In FIG. 11, the reference numeral 101 denotes a printer, 102 denotes an operation panel portion provided at the front portion of an upper surface of a housing, 103 denotes a paper feeder cassette, 104 denotes a paper (printing medium) to be supplied from the paper feeder cassette 103 and 105 denotes a paper discharge paper tray. The reference numeral 106 denotes a main body cover having an L-shaped section. The main body cover 106 is adapted to cover an opening portion 107 formed at front right portion of the housing. On the other hand, within the housing, a carriage 110 supported by a guide (not shown) or so forth is arranged. The carriage is provided in reciprocally movable fashion in the width direction of the paper passing through a paper feeding passage, namely in the longitudinal direction of the guide or so forth.

In the shown embodiment, the carriage 110 is generally constructed with a stage 110*a* horizontally held by the guide or so forth, an opening portion (not shown) formed on the stage at a location in the vicinity of the guide for receiving the ink-jet head, a cartridge garage 110*b* for receiving ink cartridges 1Y, 1M, 1C, 1BK and 1S loaded on the stage 110*a* at the front side of the opening portion, and a cartridge holder 110*a* for preventing the cartridge received within the garage 110*b* from loosing off.

The stage 110*a* is slidably supported on the guide at the rear end portion thereof. The lower side of the front end portion of the stage 110*a* is mounted on a not shown guide plate. It should be noted that the guide plate may be a plate pivotable in cantilever fashion for lifting-up a guide for preventing the paper fed through the paper feeding passage from being lifted.

In the opening portion of the stage 110*a*, ink-jet heads (not shown) are mounted in the condition directing ink ejection openings downwardly. The cartridge garage 110*b* is formed with through opening in back and forth direction for receiving the five cartridges 1Y, 1M, 1C, 1BK and 1S simultaneously. On the side portion of the outer periphery, an engaging recess 110*d* to engage with an engaging claw 110*e* of the cartridge holder 110*c* is formed.

On the front end portion of the stage 110*a*, the cartridge holder 110*a* is pivotably mounted via a hinge 116. A dimension from the front end portion of the garage 110*b* to the hinge 116 is determined in consideration of the dimension of the cartridges 1Y, 1M, 1C, 1BK and 1S protruding from the front end portion of the garage 110*b* as housed within the garage. The cartridge holder 110*c* is generally rectangular plate shape. On the cartridge holder 110*c*, a pair of the engaging claws 110*e* projecting in the direction perpendicular to the plate surface at both side portion of upper portion remote from the lower portion pivotably secured by means of the hinge 116 and adapted to engage with a pair of engaging recesses 110*d* of the garage 110*b* when the holder 110*c* is closed. On the other hand, on the holder 110*c*, an engaging hole 120 for engaging with handle portions of respective cartridges 1Y, 1M, 1C, 1BK and 1S is formed in the plate portion. The engaging hole 120 has position, configuration and size corresponding to the handle portions.

In addition, it should be noted that the ink-jet apparatus according to the present invention is applicable not only as image output terminal of an information processing apparatus, such as a wordprocessor, computer or so forth, integrally therewith or separately therefrom, but also as a copying machine as combined with a reader, a facsimile machine having transmitting and receiving function. Also, the ink-jet apparatus according to the present invention is further applicable as printing apparatus for performing printing on a cloth or a yarn.

As set forth above, according to the present invention, the ink absorbing body optimal for ink-jet can be produced through the innovative method wherein the oily material, particularly the surfactant contained in the oily material is positively utilized with adjusting the amount of the surfactant in the oily material, without degrading production ability in fiber spinning process, and with remarkably efficiency in the ink tank production process and the ink injecting process.

Particularly, in the ink tank production process, with lubricating property of the surfactant depositing on the surface, the ink absorbing body can be smoothly inserted into the housing (ink tank). Furthermore, owing to antistat property and lubricating ability of the surfactant, it becomes possible to provide the ink tank without any unexpected local concentration of density of the fiber as compressed.

On the other hand, in the ink injection process, even the synthetic fiber, such as polypropylene having hydrophobic property may have hydrophilic property by the surfactant depositing on the surface. Therefore, ink can be efficiently and certainly maintained in the ink absorbing body by simple injection means including injection means under atmospheric pressure.

Furthermore, in a printing method to suppress bleeding at boundary region between the different color regions adjacent to each other, or to obtain particularly superior water resistance by reacting cation substance and anion substance on the printing paper as the printing medium, it is possible to obtain an absorbing body having superior ink absorbing ability both for the ink containing anionic substance and for the ink containing cationic substance by employing a body including a normal fibrous body and nonionic surfactant deposited on the normal fibrous body as a superior ink storage stability therefor without employing exclusive fibrous bodies therefor. Therefore, the same fibrous body or the same fiber can be used in common for both for the ink containing anionic substance and for the ink containing cationic substance.

The present invention has been described in detail with respect to preferred embodiments, and it will not be that changes and modifications may be made without departing from the invention in its broader aspect, and it is the invention, therefore, in the appended claims to cover all such changes and modifications as fall within the true spirit of the invention.

What is claimed is:

1. An ink absorbing body in an ink tank for use in an ink let printing apparatus, said ink absorbing body comprising fibers with capillary force between said fibers for storing ink, wherein said fibers exhibit a hydrophobic characteristic relative to the ink, and wherein on a surface of said fibers, before filling the ink into the ink tank, a nonionic surfactant is deposited within a range of 0.002 to 0.2 wt % relative to a weight of the ink, wherein the surfactant reduces influences of the ink absorbing body on characteristics of the ink retained by the ink absorbing body.

2. An ink absorbing body as claimed in claim 1, wherein all of the nonionic surfactant deposited on said fibers is removable from the surface of said fibers.

3. An ink absorbing body as claimed in claim 1, wherein a part of the nonionic surfactant deposited on said fibers is removable from the surface of said fibers.

4. An ink absorbing body in an ink tank for use in an ink let printing apparatus, said ink absorbing body comprising fibers with capillary force between said fibers, wherein said fibers exhibit a hydrophobic characteristic relative to the ink, and wherein on a surface of said fibers, before filling the ink into the ink tank, a nonionic surfactant is deposited within a range of 0.01 to 0.5 wt % relative to a weight of the fibers, wherein the surfactant reduces influences of the ink absorbing body on characteristics of the ink retained by the ink absorbing body.

5. An ink absorbing body in an ink tank for use in an ink let printing apparatus, said ink absorbing body comprising fibers with capillary force between said fibers, wherein a nonionic surfactant is deposited on a surface of said fibers, the surfactant reducing influences of the ink absorbing body on characteristics of ink retained by the ink absorbing body.

6. An ink absorbing body as claimed in claim 5, wherein a dew point of said nonionic surfactant in the ink is higher than or equal to 65° C.

7. An ink absorbing body as claimed in claim 5, wherein said ink absorbing body is processed by heat forming at least the surface thereof.

8. An ink absorbing body as claimed in claim 5, wherein said fiber contains polyolefin type resin as a primary component.

9. An ink absorbing body as claimed in claim 8, wherein said polyolefin type resin is polypropylene.

10. An ink tank for use in an ink let printing apparatus, comprising:

an ink absorbing body comprising fibers with capillary force between said fibers for storing ink, said fibers exhibiting a hydrophobic characteristic relative to the ink; and a casing to house said ink absorbing body, said casing having an atmosphere communicating portion, wherein on a surface of said fibers, before filling the ink into said ink tank, a nonionic surfactant is deposited within a range of 0.002 to 0.2 wt % relative to a weight of the ink, wherein the surfactant reduces influences of the ink absorbing body on characteristics of the ink retained by the ink absorbing body.

11. An ink tank as claimed in claim 10, wherein said casing includes a side wall having an ink supply opening, and wherein said absorbing body is housed within a region of said casing at the side wall of said ink supply opening.

12. An ink tank as claimed in claim 10, wherein said casing includes a receptacle chamber for receiving said absorbing body, and wherein said receptacle chamber has an inner periphery shaped in correspondence to an outer periphery of said absorbing body.

13. An ink tank for use in an ink let printing apparatus, comprising:

an ink absorbing body comprising fibers with capillary force between said fibers for storing ink;

a casing to house said ink absorbing body, said casing having an atmosphere communicating portion; and a nonionic surfactant deposited on a surface of said fibers, the surfactant reducing influences of the ink absorbing body on characteristics of ink retained by the ink absorbing body.

14. An ink tank as claimed in claim 13, wherein said casing includes at least first and second integrally formed ink chambers respectively storing first and second ejection liquids, the first election liquid containing a cationic substance and the second ejection liquid containing an anionic substance, at least one of said ejection liquids comprising the ink.

15. An ink tank as claimed in claim 13, wherein said casing is comprised of a plurality of ink containers including at least first and second ink containers respectively storing first and second ejection liquids, the first ejecting liquid containing a cationic substance and the second ejection liquid containing an anionic substance, and a part of or all of said ejection liquids comprise the ink.

16. An ink-jet cartridge for use in an ink let printing apparatus, comprising:

an ink tank, including an ink absorbing body comprising fibers with capillary force between said fibers for storing ink;

a casing to house said ink absorbing body, said casing having an atmosphere communicating portion; and a nonionic surfactant deposited on a surface of said fibers, the surfactant reducing influences of the ink absorbing body on characteristics of ink retained by the ink absorbing body; and said ink-jet cartridge further comprising an ink-jet printing head which receives the ink from said ink tank, the ink-jet printing head for performing printing by ejecting the ink stored in said ink tank onto a printing medium.

17. An ink-jet cartridge as claimed in claim 16, wherein said ink tank is detachably mounted relative to said ink-jet printing head.

18. An ink-jet printing apparatus, comprising:

ink-jet cartridge, including:

an ink tank, having:

an ink absorbing body comprising fibers with capillary force between said fibers for storing ink;

a casing to house said ink absorbing body, said casing having an atmosphere communicating portion; and a nonionic surfactant deposited on a surface of said fibers; and said ink-let cartridge further comprising an ink-jet printing head which receives the ink from said ink tank, the ink-let printing head for performing printing by ejecting the ink stored in said ink tank onto a printing medium; and a carriage detachably mounting said ink-jet cartridge.

19. An ink-jet printing apparatus as claimed in claim 18, wherein said ink tank is detachably mounted relative to said ink-jet printing head.

20. A production process of an ink tank for use in an ink let printing apparatus which includes an ink absorbing body comprised of fibers with capillary force between said fibers and a casing to house said ink absorbing body and having an atmosphere communicating portion, said fibers exhibiting a hydrophobic characteristic relative to the ink, comprising the steps of:

depositing a nonionic surfactant on a surface of said fibers before filling the ink tank with ink, the nonionic surfactant being deposited within a range of 0.01 to 0.5 wt % relative to a weight of the fiber, wherein the surfactant reduces influences of the ink absorbing body on characteristics of the ink retained by the ink absorbing body;

inserting said ink absorbing body into said casing; and injecting ink into said ink absorbing body.

21. An ink tank production process as claimed in claim 20, further comprising a step of preparing long fibers and short fibers, and wherein said step of depositing the nonionic surfactant is performed in said step of preparing long fibers and short fibers.

22. An ink tank production process as claimed in claim 20, which further comprises a step of performing compression heat forming of a fiber aggregate to have an external surface corresponding to an interior configuration of said casing.

* * * * *

UNITED STATES PATENT AND TRADEMARK OFFICE

CERTIFICATE OF CORRECTION

PATENT NO. : 6,234,618 B1
DATED : May 22, 2001
INVENTOR(S) : Yamamoto et al.

It is certified that error appears in the above-identified patent and that said Letters Patent is hereby corrected as shown below:

Title page,
Item [74] Attorney, Agent, or Firm, "Fitzparick, Cella, Harper & Scinto" should read -- Fitzpatrick, Cella, Harper & Scinto --.

Column 2,
Line 22, "through" should read -- thought --.

Column 5,
Line 48, "is" should read -- as --; and
Line 61, "be these" should read -- be noted that these --.

Column 7,
Line 37, "subject" should read -- subject to the --.

Column 8,
Line 4, "measure has been" should read -- measures that have been --;
Line 6, "complicate" should read -- complicated --; and
Line 21, "entire of the regions" should read -- entire region --.

Column 10,
Line 2, "contained" should read -- containing --; and
Line 53, "cause" should read -- caused --.

Column 11,
Line 25, "require" should read -- requires an --;
Line 27, "complicate" should read -- complicated --;
Line 35, insert "a" after "in" and "to" should read -- with --; and
Line 40, insert "a" before "dedicated" and delete "the".

Column 14,
Line 61, "let" should read -- jet --.

UNITED STATES PATENT AND TRADEMARK OFFICE

CERTIFICATE OF CORRECTION

PATENT NO. : 6,234,618 B1
DATED : May 22, 2001
INVENTOR(S) : Yamamoto et al.

It is certified that error appears in the above-identified patent and that said Letters Patent is hereby corrected as shown below:

Column 15,
Lines 12 and 23, "let" should read -- jet --.

Column 16,
Lines 20, 49, 51 and 59, "let" should read -- jet --.

Signed and Sealed this

Second Day of April, 2002

*Attest:*

*Attesting Officer*

JAMES E. ROGAN
*Director of the United States Patent and Trademark Office*